United States Patent [19]

Wilson

[11] Patent Number: 4,697,687

[45] Date of Patent: Oct. 6, 1987

[54] COIN ACTUATED APPLIANCE WITH COIN COLLECTING APPARATUS

[75] Inventor: James D. Wilson, Newton, Iowa

[73] Assignee: The Maytag Company, Newton, Iowa

[21] Appl. No.: 819,206

[22] Filed: Jan. 15, 1986

[51] Int. Cl.[4] ..... G07F 17/20

[52] U.S. Cl. ..... 194/344; 194/350; 232/15; D32/5

[58] Field of Search ..... 194/350, 346–349, 194/344, 241, 242; 232/15, 16; 68/20; D32/5, 8

[56] References Cited

U.S. PATENT DOCUMENTS

| | | | |
|---|---|---|---|
| 1,685,219 | 9/1928 | Lorentzen | 232/15 |
| 2,828,909 | 4/1958 | Sollenberger et al. | 194/350 X |
| 3,455,425 | 7/1969 | Douglas | 194/350 |
| 3,770,090 | 11/1973 | Fayling et al. | 194/350 |
| 4,399,903 | 8/1983 | McDonald | 194/350 |
| 4,534,188 | 8/1985 | Fey | 68/20 X |

FOREIGN PATENT DOCUMENTS

| | | | |
|---|---|---|---|
| 222407 | 3/1958 | Australia | 68/20 |

OTHER PUBLICATIONS

Speed Queen Form 100-1C, "High Security Stacked Dryer", Speed Queen Company, Ripon, WI.

*Primary Examiner*—F. J. Bartuska
*Attorney, Agent, or Firm*—Richard L. Ward

[57] ABSTRACT

A coin actuated appliance is provided which includes first and second stacked laundry machines having first and second enclosing cabinets. A housing defines a generally closed vault within an intermediate support member which supports the second laundry machine above the first laundry machine. The coin collecting apparatus includes a box-like structure movable into and out of the vault. Coin diverting apparatus is provided with the coin collecting apparatus for urging coins from the egress of a coin acceptor device toward the end of the box-like structure opposite the coin diverting apparatus.

4 Claims, 6 Drawing Figures

COIN ACTUATED APPLIANCE WITH COIN COLLECTING APPARATUS

BACKGROUND OF THE INVENTION

This invention relates generally to the field of coin actuated appliances and vending machines and more particularly to a coin actuated stacked appliance and improved coin collecting apparatus therefor. The coin collecting apparatus for the stacked appliance includes a vertically shallow, generally horizontally elongated box-like structure and means for deflecting coins fron one end toward the other end of the box-like structure to fully utilize the storage capacity of the box-like structure.

Prior coin collection systems have generally utilized coin boxes located directly below the outlet of a coin slide or coin drop. As coins accumulated in these boxes they tended to stack in a substantially conical pattern generally below the outlet of the coin slide or coin drop. An example of this type of coin box is shown in U.S. Pat. No. 3,455,425 issued to Peyton W. Douglas on July 15, 1969.

In U.S. Pat. No. 4,399,903 issued to Winford G. McDonald on Aug. 23, 1983 there is disclosed a coin box for a particular type of dispensing machine. This coin box is enlarged by extending the coin box rearwardly and by providing an inclined, forwardly extending, top wall which allows the dispensed product to be deflected behind the coin box and then routed toward a dispensing slot.

There has been no known prior showing of a coin collecting apparatus for use with a coin actuated appliance as shown in the instant invention. The coin collecting apparatus includes a coin receiver and a vertically shallow but horizontally elongated coin box with coin diverting means operably disposed relative to the coin receiver. The coin diverting means deflects coins in a generally diagonal path toward the rear of the coin box to provide for utilization of substantially the entire horizontal length of the coin box for storage.

SUMMARY OF THE INVENTION

It is therefore an object of the instant invention to provide a coin actuated stacked appliance having an improved coin collecting apparatus.

It is a further object of the instant invention to provide a coin actuated stacked appliance with coin collecting apparatus including a coin box having substantially increased storage capacity and coin diverting means for utilizing that capacity.

Briefly, the instant invention achieves these objects in a coin actuated stacked appliance including first and second stacked laundry machines having first and second enclosing cabinets. A support member between the first and second cabinets includes generally upstanding walls cooperable with the first and second cabinets for supporting the second laundry machine in an operative posture above the first laundry machine. The support member defines a compartment generally between the first and second laundry machines. A coin accepting device is disposed at least partially within the second cabinet and is operable for receiving coins to initiate actuation of the first or second laundry machines. A housing defines a substantially closed vault disposed generally within the compartment. A portion of the housing extends through an aperture in the support member and includes an access opening for providing access to the vault. The coin collecing apparatus includes a box-like structure operable for movement into and out of the vault through the access opening. The box-like structure further includes an open portion for receiving coins. Coin diverting members are operably disposed for receiving coins from a first generally vertical direction of travel at a discharge area of the coin accepting device to a second generally horizontal direction of travel within the coin collecting apparatus. The coin diverting members and a wall portion of the box-like structure are cooperable for effecting the deposit of coins in the end of the box-like structure opposite the coin diverting members.

Operation of the improved coin collecting apparatus and further objects and advantages thereof will become evident as the description proceeds and from an examination of the accompanying four sheets of drawings.

BRIEF DESCRIPTION OF THE DRAWINGS

The drawings illustrate a preferred embodiment of the invention with similar numerals referring to similar parts throughout the several views, wherein.

DESCRIPTION OF A PREFERRED EMBODIMENT

Figure 1:
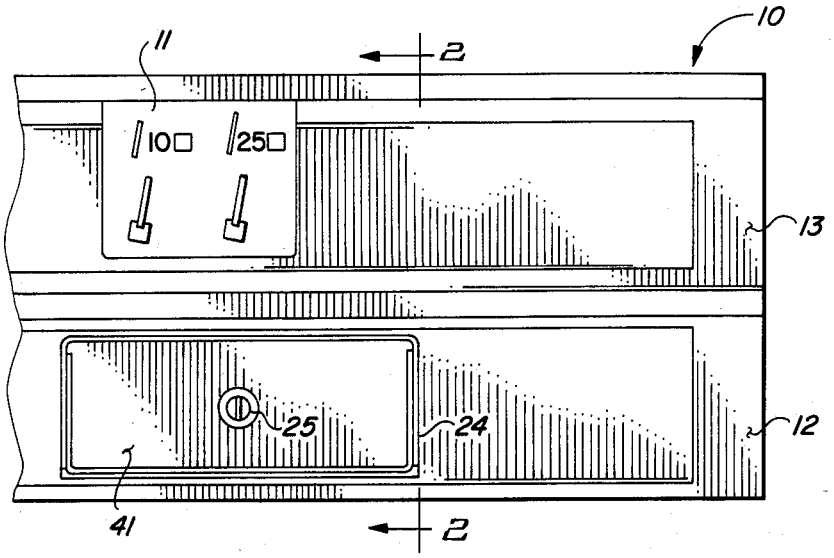
FIG. 1 is a partial front view of the control panel for a coin actuated appliance and specifically shows a coin drop and coin vault.
Figure 2:
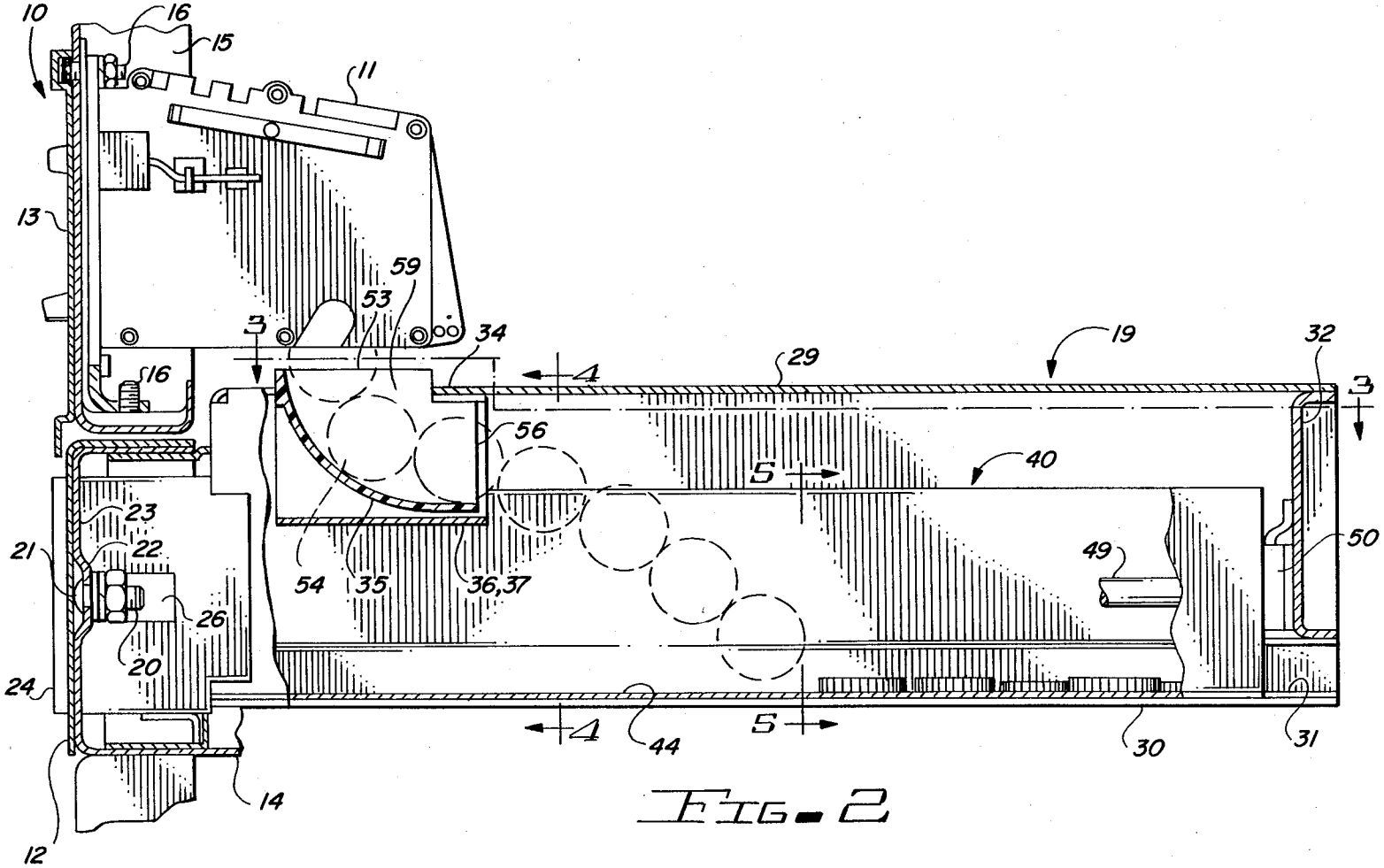
FIG. 2 is a fragmentary section view taken generally along lines 2—2 of FIG. 1 showing a side view of the coin collecting apparatus including the coin drop and the interior of the coin box and coin vault.
Figure 6:
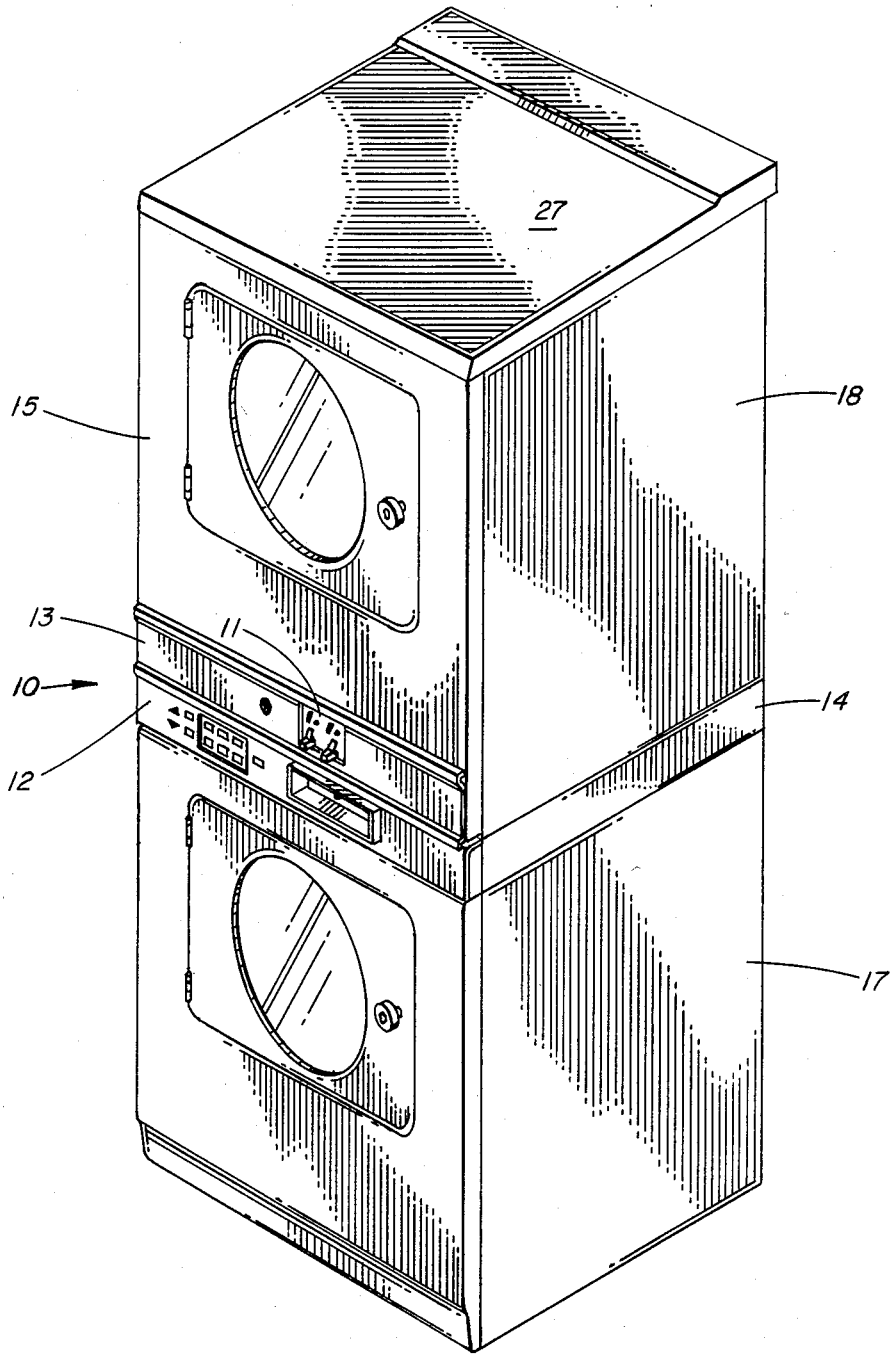
FIG. 6 is a perspective view of a pair of stacked appliances utilizing the coin collecting apparatus.

Referring now to the drawings, there are shown in FIGS. 1, 2 and 6 portions of an appliance control panel 10 utilized for mounting a coin acceptor device such as a coin slide or a coin drop 11. In the instant invention, the term "coin" is intended to include, in addition to the ten and twenty-five cent United States denominations, other common United States coins. Also, the term "coin" is intended to include foreign coins and miscellaneous tokens and checks which may be used in place of money. The control panel 10 of FIGS. 1, 2 and 6 is composed of lower and upper extrusions 12 and 13 which are secured to a vault mounting structure 14 and to a front panel 15 of a controlled appliance 18. As best shown in FIG. 2, the upper extrusion 13 overlaps the lower extrusion 12 to give the general appearance of a unitary control panel 10. In one embodiment of the invention, as best shown in FIG. 6, a pair of laundry appliances 17 and 18 are stacked one on top of the other through the vault mounting structure 14. The vault mounting structure 14 is secured to the top of the first appliance 17 and defines a support member for the second appliance 18.

As further shown in FIG. 2, the coin drop 11 is secured to the rear of the front panel 15 of the upper or second appliance 18 by means of mechanical fasteners 16. The coin vault 19 is secured within the compartment 37 formed by the vault mounting structure 14 directly below the coin drop 11 by means of mechanical fasteners 20 which are hidden behind the lower extrusion 12 with the heads 21 recessed in embossments 22 in the front wall 23 of the vault mounting structure 14.

Referring now to FIG. 6 in particular, there is shown the second appliance 18 mounted in a stacked arrangement above the first appliance 17 through the vault mounting structure 14. In this arrangement, the vault mounting structure 14 comprises a weldment of front, rear and side channel members joined to form a four-sided structure which is open at the top and bottom. The channel members which make up the vault mounting structure 14 are formed from steel which is at least twice as thick as the steel used in the cabinetry of the first and and second appliances 17 and 18. The welded construction provides an integral vault mounting structure 14 which is relatively secure from vandalism.

Referring again to FIG. 6, it is noted that the illustrated first and second appliances 17 and 18 are, in this embodiment, fabric dryers. The arrangement of FIG. 6 is created by joining a pair of substantially production appliances 17 and 18 through the vault mounting structure 14. Creation of the appliance arrangement shown in FIG. 6, while providing a secure generally vandal-proof vault mounting structure 14, has necessitated unique design and placement of components such as the coin drop 11 and coin vault 19 to achieve the illustrated structure. The top cover 27 for the second appliance 18 is a standard production part while the first appliance 17 does not include a corresponding component but which is effectively replaced by the vault mounting structure 14. As shown by phantom lines in FIG. 4, the fabric tumbler 28 of the first appliance 17 is rotatable about a substantially horizontal axis between the front and rear of the appliance 17. The radius of the fabric tumbler 28 extends into the vault mounting structure 14.

As viewed from the front in FIG. 6, the lower right-hand side of the first and second appliances 17 and 18 include the heating apparatus therefor (not shown). Because of the radius of the fabric tumbler 28 and the location of the heating apparatus, the coin drop 11 and coin vault 19 were located between the radius of the fabric tumbler 28 and the heating apparatus.

Figure 4:
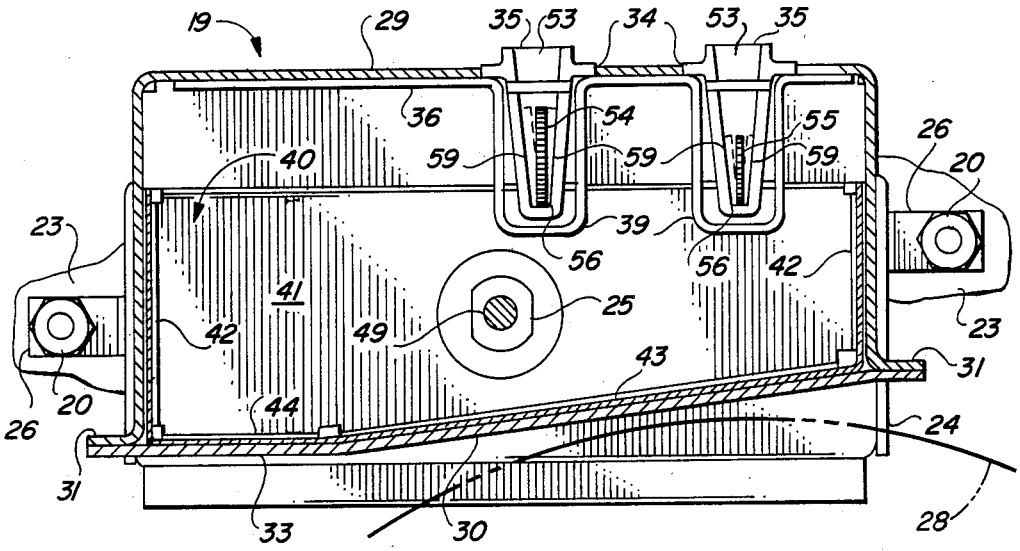
FIG. 4 is a section view taken generally along line 4—4 of FIG. 2 showing the coin box and coin deflector chutes.

If space within the appliances 17 and 18 was not a limitation, the coin drop 11 and coin vault 19 could be mounted on the right-hand side of the second appliance 18, the coin vault 19 and the coin receiving box 40 could be vertically elongated into appliance 17 and provide great monetary capacity. However, because of the space limitations in a combined appliance, the coin vault 19 is provided with a side-to-side sloping bottom wall 30 to clear the radius of the fabric tumbler 28 as shown in FIG. 4. Because of the limited vertical space within the vault mounting structure 14, the coin vault 19 and the coin receiving box 40 are required to be vertically shallow but horizontally extended or elongated to accommodate the desired quantity of coins and a system for utilizing this horizontally elongated coin receiving box 40 is necessary.

Thus, to utilize the vertically shallow but horizontally elongated coin box 40 and its side-to-side sloping bottom wall 43, the coin drop 11 was mounted on the left side of the coin vault 19 and the coin box 40 as best shown in FIGS. 1 and 6. In order to project or divert insert coins 54 and 55 from a generally vertical direction of travel at the egress of the coin drop 11 to a generally horizontal direction of travel within the coin box 40, a pair of coin chutes 35 are utilized which change the direction of travel of the coins 54 and 55 to the generally horizontal direction and onto the side-to-side sloping bottom wall 43 of the coin box 40. The sloping bottom wall 43 of the coin box 40, which was selected in conjunction with the location and radius of the fabric tumbler 28, is used advantageously in combination with the coin chutes 35 to move coins 54 and 55 toward the rear of the coin box 40 so that these coins 54 and 55 will fill the coin box 40 from the rear toward the front.

Figure 3:
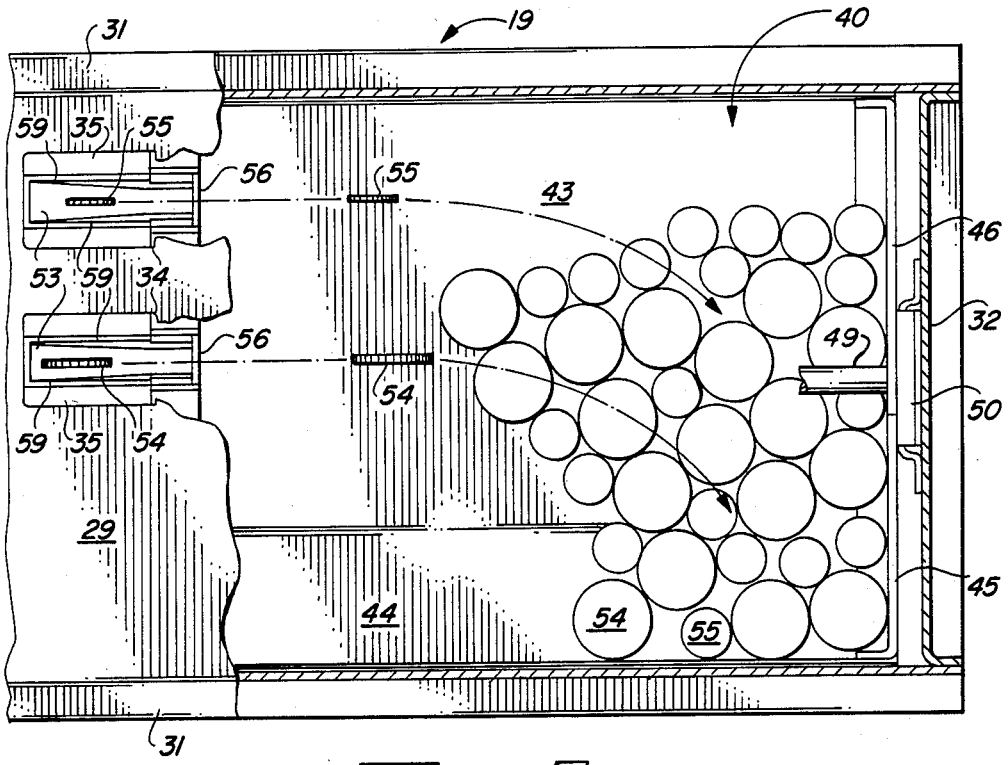
FIG. 3 is a view taken generally along lines 3—3 of FIG. 2 showing the top wall of the coin vault removed and the general path of the coins between the coin drop and coin box.

Turning now to FIGS. 2–4 and focusing on the physical limitations imposed by the structure of FIG. 6, the coin vault 19 is shown as a substantially rectangular horizontally elongated box structure. The coin vault 19 is, as previously discussed, characterized as being vertically shallow as compared to its horizontal dimensions. As best shown in FIG. 2, the coin vault includes a generally rectangular collar portion 24 extending forwardly through the front wall 23 of the vault mounting structure 14 and through the lower extrusion 12. The collar portion 24 provides vandalism protection for the coin receiving box 40 by effectively preventing the use of a pry bar for prying the coin receiving box 40 from the coin vault 19. In addition, the collar portion 24 carries a pair of mounting ears 26 cooperable with mechanical fasteners 20 for securing the coin vault 19 to the front wall of the vault mounting structure 14.

The rearwardly extending portion of the coin vault 19 is a generally rectangular weldment made up of a three-sided upper wrapper 29 and a bottom wall 30. The upper wrapper 29 and the bottom wall 30 are joined by welding at the flanges 31. The rear of the coin vault 19 is closed by welding or otherwise attaching a rear wall 32 between the upper wrapper 29 and the bottom wall 30. As best shown in FIG. 4, which views the coin vault 19 from within and looking forward, the bottom wall 30 slopes downwardly from right to left toward a substantially flat area 33.

As best shown in FIGS. 3 and 4, the left front corner of the three-sided upper wrapper 29 of the coin vault 19, when viewed from the front, includes a pair of rectangular cut-outs 34 for receiving a pair of arcuately shaped coin chutes 35 which will be further discussed herein. Attached to the underside of the three-sided upper wrapper 29 is a bracket 36 having a pair of U-shaped segments 39 formed therein. The U-shaped segments 39 are aligned below the rectangular cut-outs 34 and protect the coin chutes 35 as the coin receiving box 40 is moved into and out of the coin vault 19.

Figure 5:
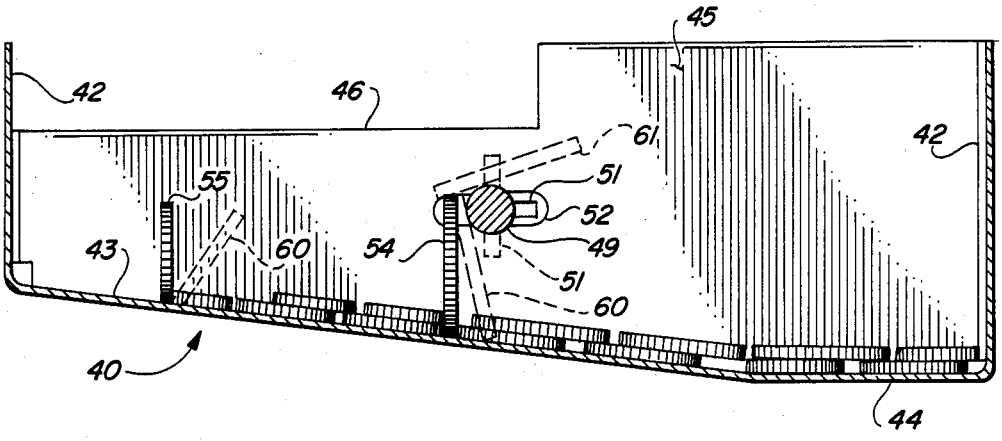
FIG. 5 is shown out of order with FIG. 1 and is a section view taken generally along lines 5—5 of FIG. 2 showing the rear of the coin box.

The coin receiving box 40 includes a rectangular front wall portion 41, as shown in FIGS. 1 and 4, sized to fit snugly within the forwardly extending collar portion 24 of the coin vault 19 so that pry bars are precluded from engaging with the edges of the front wall portion 41. The front wall portion 41 also mounts the key lock mechanism 25. The rear portion of the coin receiving box 40 is best shown in cross section in FIGS. 4 and 5. As shown, the rear portion of the coin receiving box includes vertically extending side walls 42 and a bottom wall 43 which slopes downwardly from left to right toward a substantially flat area 44 when viewed from the front as in FIGS. 1 and 5. The top of the coin receiving box 40 is open and the left side of the vertically extending rear wall 45 is notched, as shown in FIG. 5 and indicated by numeral 46, to provide clearance for the previously described bracket 36 attached to the underside of the upper wrapper 29.

The coin receiving box 40 is locked within the coin vault 19 by means of a lock rod 49 which extends from the key lock mechanism 25 in the front wall 41 of the coin receiving box 40 and horizontally along the approximate side-to-side center line of the coin receiving box 40. The lock rod 49 engages with a bracket 50 attached to the rear wall 32 of the coin vault 19. As further shown in FIG. 5, the end of the lock rod 49 carries a locking bar 51 which passes through a slotted opening 52 in the bracket 50. When the lock rod 49 is rotated to a locking posture the locking bar 51 is in a vertical position, shown in dashed lines in FIG. 5, and the coin receiving box 40 cannot be removed from the coin vault 19.

Referring again to FIGS. 2–4, there are shown a pair of coin deflecting chutes 35 positioned in the rectangular cut-outs 34 of the upper wrapper 29 of the coin vault 19. The entry ends 53 of the coin deflecting chutes 35 are positioned directly below the egress openings of the coin drop 11 for receiving the vertically oriented coins 54 and 55 as they leave the coin drop. As best shown in cross section in FIG. 2, the coin deflecting chutes 35 have an arcuate shape between the entry end 53 and the exit end 56 for diverting coins 54 and 55 leaving the coin drop 11 through a substantially 90° angle. The coins are rerouted from a substantially vertical direction of travel at the egress of the coin drop 11 to a generally horizontal direction of travel as they leave the exit end 56 of the coin deflecting chutes 35. As further shown in FIG. 4, the side walls 59 of the coin deflecting chutes 35 taper inwardly from top to bottom. These inwardly tapering side walls 59 aid in keeping the coins 54 and 55 vertically oriented as they traverse the coin deflecting chutes 35 by reducing wobble and bounce which, in turn, helps to maintain maximum rolling velocity.

As coins 54 and 55 are fed into the coin drop 11 to initiate operation of the appliance or a vend operation, they will drop into the coin deflecting chutes 35 which will deflect them toward the rear of the coin receiving box 40. As previously shown and discussed herein, the coin drop 11 is physically located just above the upper left hand corner of the coin vault 19 and coin receiving box 40 when viewed from the front as in FIG. 1. Also, the bottom wall of the coin receiving box 40 slopes downward from left to right when viewed from the perspective of FIG. 1. Thus, as coins 54 and 55 exit the coin deflecting chutes 35 they will be substantially vertically oriented due to the controlling effect of the tapering side walls 59. The coins 54 and 55 will travel in a generally horizontal direction toward the rear of the coin receiving box 40 before contacting the sloping bottom wall 43. Once contact has been made with the sloping bottom wall 43, the coins 54 and 55 will roll or slide generally diagonally down the slope to the right side of the coin receiving box 40 and will begin to build from the rear to the front of the coin receiving box 40 in a substantially triangular pattern as shown in FIG. 3.

As the layers of coins 54 and 55 build up in the coin receiving box 40, the larger coins 54, such as quarters, will initially roll parallel to the substantially horizontal axis of the lock rod 49. These coins 54 will at first have a tendency to tip under the lock rod 49 as indicated by numeral 60 in FIG. 5. When the layers are built up so that the coins 54 and 55 cannot tip under the lock rod 49 they will begin to spill over the top of the lock rod 49 as further indicated by numeral 61 in FIG. 5. As previously mentioned, the coins 54 and 55 tend to build in a substantially triangular pattern extending generally diagonally from the right rear corner to the left front corner of the coin receiving box 40. As the appliance operates, gentle vibrations produced by the appliance will have a tendency to enhance the layering or stacking of coins 54 and 55 within the coin receiving box 40.

There has thus been described herein improved coin collecting apparatus for use with a coin actuated appliance such as a stack pair of fabric dryers and which takes advantage of design limitations imposed by the physical characteristics of the appliance. There is provided a coin receiving box which is vertically shallow but horizontally elongated and coin deflecting chutes which are operable for deflecting coins received from a coin drop in a substantially diagonal path toward the rear of the coin receiving box to provide for utilization of substantially the entire horizontal length of the coin receiving box for storage.

In the drawings and specification, there has been set forth a preferred embodiment of the invention and although specific terms are employed, these are used in a generic and descriptive sense only and not for purposes of limitation. Changes in the form and the proportion of parts as well as the substitution of equivalents are contemplated as circumstances may suggest or render expedient without departing from the spirit or scope of the invention as defined in the following claims.

I claim:

1. A coin actuated stacked appliance including first and second stacked laundry machines having first and second enclosing cabinets, the combination comprising: support means between said first and second cabinets including generally upstanding peripheral wall means cooperable with said first and second cabinets for supporting said second laundry machine in an operative posture above said first laundry machine, said support means defining a compartment between said first and second laundry machines; a single coin accepting means disposed at least partially within said second cabinet and operable for receiving coins to initiate actuation of said first and second laundry machines; housing means defining a vertically shallow and horizontally enlarged substantially closed vault including a generally rectangular structure extending horizontally lengthwise into said compartment, a portion of said housing means extending through an aperture in said peripheral wall means and defining an access opening for providing access to said vault; coin collecting means including a vertically shallow and horizontally enlarged box-like structure proportioned to extend lengthwise within said vault, said box-like structure having laterally sloping bottom wall means generally aligned with said coin accepting means for laterally urging coins to one side of said box-like structure, said coin collecting means operable for movement into and out of said vault through said access opening, said box-like structure defining an open portion for receiving coins and a coin storage area rearwardly and laterally displaced from said coin accepting means; and coin diverting chute means mounted within said vault and including a rearwardly directed exit end disposed at least partially in said box-like structure, said coin diverting chute means operable for receiving coins from said coin accepting means and for directing coins from a first generally vertical direction of travel at the egress of said coin accepting means to a second generally horizontal and rearward direction of travel at said exit end of said coin diverting chute means onto said sloping bottom wall means within said coin collecting means, said coin diverting chute means and said sloping bottom wall means of said box-like structure being cooperable to rearwardly direct and laterally urge said coins within said coin collecting means for effecting the deposit of said coins in said coin storage area.

2. A coin actuated stacked appliance as defined in claim 1 wherein said coin diverting means is mounted on one side of said vault and said sloping bottom wall means slopes downwardly away from said coin diverting means.

3. A coin actuated stacked appliance including first and second stacked laundry machines having first and second enclosing cabinets, the combination comprising: support means between said first and second cabinets including generally upstanding peripheral wall means cooperable with said first and second cabinets for supporting said second laundry machine in an operative posture above said first laundry machine, said support means defining a compartment between said first and second laundry machines; a single coin accepting means disposed at least partially within said second cabinet and operable for receiving coins to initiate actuation of said first and second laundry machines; housing means joined to said support means and defining a vertically shallow and horizontally enlarged substantially closed vault including a generally rectangular structure extending horizontally lengthwise into said compartment, said housing means including a portion extending through an aperture in said peripheral wall means and defining an access opening for providing access to said vault; coin collecting means including a vertically shallow and horizontally enlarged box-like structure proportioned to fit lengthwise within said vault, said box-like structure having a side-to-side sloping bottom wall portion generally aligned with said coin accepting means for laterally urging coins to one side thereof, said box-like structure operable for movement in and out of said vault through said access opening, said box-like structure further defining an open portion for receiving coins and a coin storage area including a generally horizontal bottom wall portion rearwardly and laterally displaced from said coin accepting means; and coin chute means operably disposed within said vault and including an arcuate portion between an entry end and an exit end, said exit end being rearwardly directed and disposed at least partially in said box-like structure, said coin chute means operable for diverting said coins from a first generally vertical to a second generally horizontal direction of travel and providing a rearward impulse from said exit end for directing coins from the egress of said coin accepting means rearwardly onto said side-to-side sloping bottom wall portion of said box-like structure, said coin chute means and said side-to-side sloping bottom wall portion combining to rearwardly direct and laterally urge said coins toward said coin storage area.

4. A coin actuated stacked appliance as defined in claim 3 wherein said arcuate portion of said coin chute means has top-to-bottom inwardly tapering side walls for reducing coin bounce and wobble to effectively stabilize said coins while maintaining rolling velocity thereof.

* * * * *